US009126451B2

(12) United States Patent
Chakar et al.

(10) Patent No.: US 9,126,451 B2
(45) Date of Patent: Sep. 8, 2015

(54) THERMAL RECORDING MATERIALS

(71) Applicant: Appvion, Inc., Appleton, WI (US)

(72) Inventors: Fadi Chakar, Appleton, WI (US); John Charles Warner, Wilmington, MA (US); Justin Robert Whitfield, Billerica, MA (US); Michelle Wanchi Li Lugus, Reading, MA (US); Deboshri Banerjee, Malden, MA (US)

(73) Assignee: APPVION, INC., Appleton, WI (US)

( * ) Notice: Subject to any disclaimer, the term of this patent is extended or adjusted under 35 U.S.C. 154(b) by 69 days.

(21) Appl. No.: 14/132,984

(22) Filed: Dec. 18, 2013

(65) Prior Publication Data

US 2015/0165806 A1 Jun. 18, 2015

(51) Int. Cl.

| | |
|---|---|
| ***B41M 5/337*** | (2006.01) |
| ***B41M 5/327*** | (2006.01) |
| ***B41M 5/333*** | (2006.01) |

(52) U.S. Cl.

CPC ..... *B41M 5/3375* (2013.01); *B41M 5/3275* (2013.01); *B41M 5/3335* (2013.01); *B41M 5/3372* (2013.01); *B41M 2205/04* (2013.01); *B41M 2205/24* (2013.01)

(58) Field of Classification Search

CPC ..... B41M 5/30–5/3377

USPC ..... 503/200–226

See application file for complete search history.

(56) References Cited

U.S. PATENT DOCUMENTS

| | | | | |
|---|---|---|---|---|
| 3,539,375 | A | 11/1970 | Baum | |
| 3,674,535 | A | 7/1972 | Blose et al. | |
| 3,746,675 | A | 7/1973 | Blose et al. | |
| 4,151,748 | A | 5/1979 | Baum | |
| 4,181,771 | A | 1/1980 | Hanson et al. | |
| 4,246,318 | A | 1/1981 | Baum | |
| 4,421,560 | A * | 12/1983 | Kito et al. | 106/31.2 |
| 4,470,057 | A | 9/1984 | Glanz | |
| 4,531,140 | A | 7/1985 | Suzuki et al. | |
| 4,794,102 | A | 12/1988 | Petersen et al. | |
| 5,098,882 | A | 3/1992 | Teraji et al. | |
| 5,955,398 | A | 9/1999 | Fisher et al. | |
| 6,566,301 | B2 | 5/2003 | Mathiaparanam et al. | |
| 6,835,691 | B2 | 12/2004 | Mathiaparanam et al. | |
| 6,921,740 | B1 | 7/2005 | Hizatate et al. | |

* cited by examiner

*Primary Examiner* — Bruce H Hess

(74) *Attorney, Agent, or Firm* — Muncy, Geissler, Olds & Lowe, P.C.

(57) ABSTRACT

A thermal recording material having a heat-sensitive color-forming layer that contains a phosphate modifier in addition to an activator and lueco dye can provide good imaging. The phosphate modifier such as unsubstituted dibenzyl phosphate can be paired with an activator such 3-(4-hydroxyphenyl) propionic acid to provide an environmentally friendly thermal recording material.

20 Claims, No Drawings

THERMAL RECORDING MATERIALS

BACKGROUND OF THE INVENTION

The present invention relates to thermal recording materials that produce color in response to heat.

Thermal recording materials, as a class, are well known. The recording material generally comprises a support carrying a color-forming composition that is thermally sensitive; i.e., changes color upon sufficient heating. The color-forming composition has two main components: a color-forming dye (electron-donating dye precursor), also known as a leuco dye, and an acidic developer. The leuco dye and acidic developer are usually dispersed in a binder. Sufficient heating will permit the acidic developer to react with the leuco dye which results in the formation of a color at the site of the heating. This basic system is described in many patents including U.S. Pat. Nos. 3,539,375; 3,674,535; 3,746,675; 4,151,748; 4,181,771; 4,246,318; 4,470,057; and 5,955,398.

In typical thermal systems, in addition to the leuco dye and developer, the color-forming composition may also contain another material that aids in color formation; sometimes called a modifier. These additional material(s) can function by lowering the melting point of the dye/developer and/or by acting as a type of solvent in which the dye and developer dissolve. In this way, the reaction between a leuco dye and a developer is often more easily facilitated. The result is the formation of a more intense image and/or faster imaging. See for example, U.S. Pat. Nos. 4,531,140; 4,794,102; 5,098,882; 6,835,691; and 6,921,740.

A variety of acidic developers are described in the art including phenolic compounds; e.g., monophenols and diphenols, as taught in U.S. Pat. Nos. 3,539,375 and 6,566,301.

It is desirable to find new modifiers and developer systems, especially ones that could be more environmentally friendly.

SUMMARY OF THE INVENTION

The present invention relates to the discovery of a new modifier for use in a developer system for a thermal recording material. Accordingly, an aspect of the invention relates to a thermal recording material, which comprises a substrate having provided thereon a heat-sensitive color-forming layer; said color-forming layer comprising a binder having dispersed therein, and in a substantially contiguous relationship, a leuco dye, an activator, and a phosphate modifier; wherein said phosphate modifier is selected from one or more compounds of Formula I:

Formula I

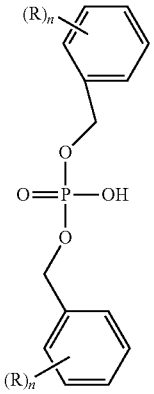

wherein each R is independently selected from an alkyl group or an alkoxy group; and n is an integer from 0 to 3. An unsubstituted dibenzyl phosphate wherein n is zero (0) is a preferred modifier compound. In some embodiments, the activator is preferably one or more compounds of formula II:

Formula II

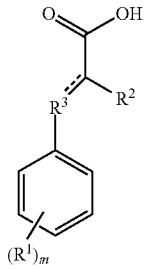

wherein $R^1$ is hydroxyl or an alkoxy group; $R^2$ is hydrogen, hydroxyl, or amino; $R^3$ is a C1 to C4 hydrocarbon linking group; and m is an integer of 1 to 3.

Another aspect of the invention relates to a thermal recording material, which comprises a substrate having provided thereon a heat-sensitive color-forming layer that comprises a leuco dye, 3-(4-hydroxyphenyl)propionic acid, and dibenzyl phosphate dispersed in a binder and in substantially contiguous relationship.

DETAILED DESCRIPTION OF THE INVENTION

The present invention is based on the discovery that certain substituted and unsubstituted dibenzyl phosphate compounds can be useful modifiers in various thermal recording materials. In general, a thermal recording material comprises a substrate and a heat-sensitive color-forming layer provided thereon. The heat-sensitive color-forming layer in the present invention comprises a leuco dye, an activator, and a phosphate modifier material. These ingredients are dispersed in a binder and arranged so as to be in a substantially contiguous relationship. The phosphate modifier compound is, together with the leuco dye and activator, believed to participate in the formation of color and/or facilitates the formulation of color. The phosphate modifiers according to the invention are one or more compounds of formula I:

Formula I

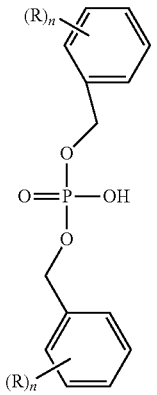

wherein each R is independently selected from an alkyl group or an alkoxy group; and n is an integer from 0 to 3. The alkyl and alkoxy groups typically have 1-8 carbon atoms, more typically 1-6 carbon atoms and often 1, 2, or 3 carbon atoms. The groups can be straight or branched chain. The number of R groups on each ring, which is represented by "n," is typically 1 or zero, though 2 or 3 substituents are possible. Typically all of the R groups, when present, are the same. An unsubstituted dibenzyl phosphate wherein n is zero (0) is a particularly preferred modifier compound.

Illustrative, but non limiting, examples of the compounds according to Formula I include:

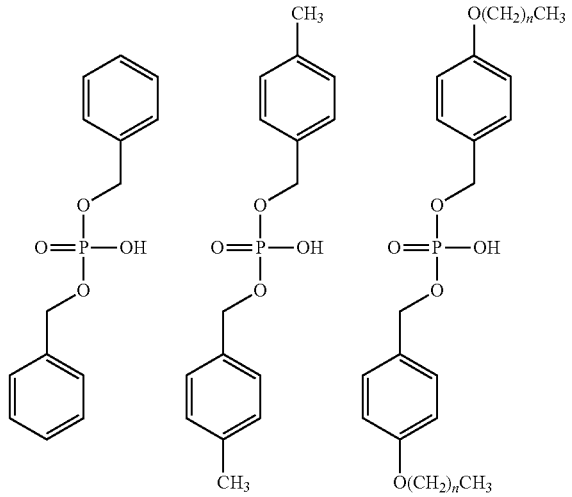

where n is an integer from 1 to 3

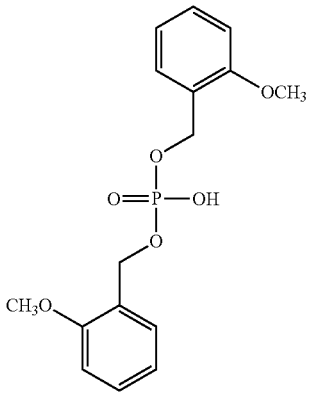

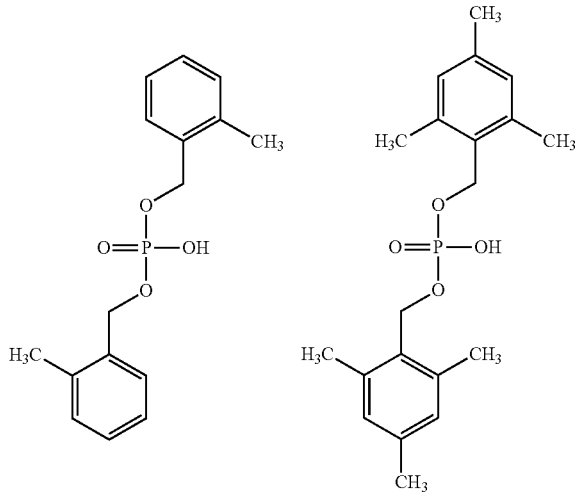

-continued

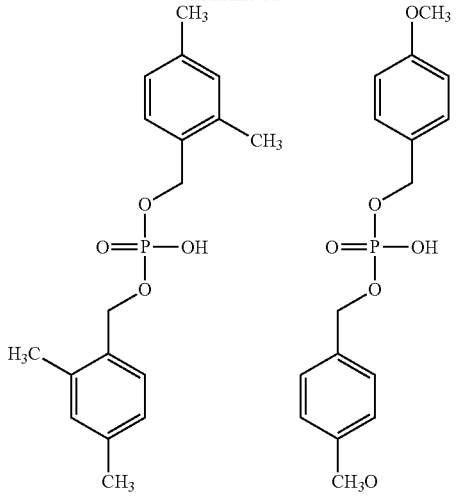

Other modifiers may also be present. But typically the phosphate modifiers of formula I account for at least 50% (by weight), more typically at least 90%, and most often 100% of the modifiers present in the heat-sensitive color-forming layer.

The heat-sensitive color-forming layer also contains an activator. As used herein, an activator comprises any acidic material capable of developing a leuco dye. While in general any of the known developers in the prior art can be used as activators in the present invention, certain compounds are preferred for use as an activator. For instance, in some embodiments the activator is an alkanoic or alkenoic compound, such as benzoic acid, 3,4-dihydroxyphenyl acetic acid, citric acid, salicylic acid, ascorbic acid, or tryptophan. A preferred class of activator are compounds of formula II:

Formula II

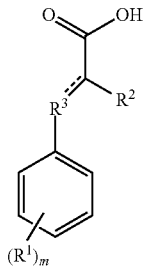

wherein $R^1$ is hydroxyl or an alkoxy group. The alkoxy group typically has 1-8 carbon atoms, more typically 1-6 carbon atoms, and often 1-4 carbon atoms and includes methoxy, ethoxy, etc. Most often, however, $R^1$ is hydroxyl. The number of $R^1$ groups, shown by the variable "m," is 1 to 3 and typically 1. $R^2$ is hydrogen, hydroxyl, or amino and typically is hydrogen. $R^3$ is a C1 to C4 hydrocarbon linking group. The dashed line represents an optional double bond between the terminal carbon atom in the $R^3$ group and the carbon atom to which $R^2$ is attached. $R^3$ is a saturated hydrocarbon, other than the optional double bond just described, and is typically 1 or 2 carbons in length and often 1 carbon (e.g. a methylene linking group).

Illustrative, but non limiting, examples of compounds according to Formula II include:

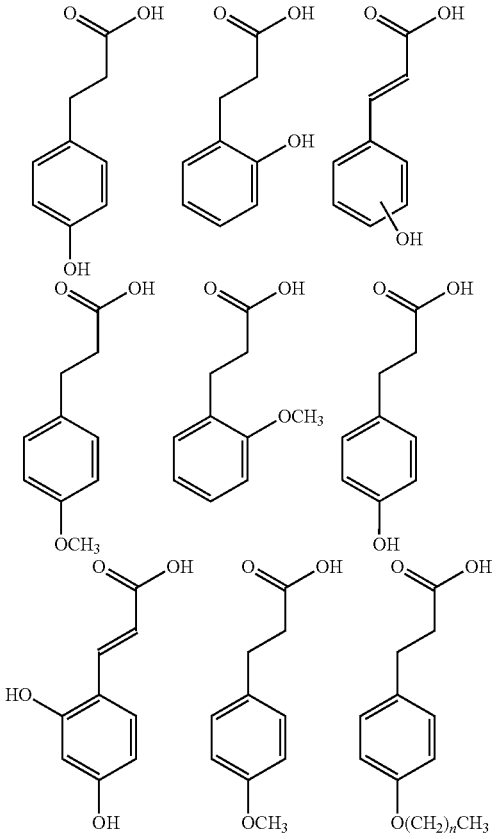

where n is an integer from 1 to 3

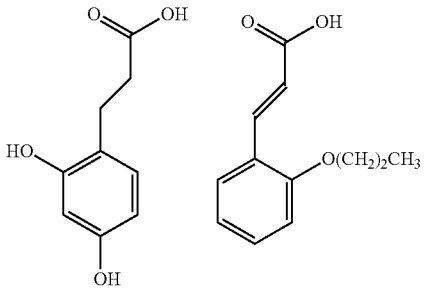

An activator of formula II can provide environmental advantages, especially in combination with the phosphate modifiers of formula I. Such a combination of activator and modifier makes for a preferred developer system. Other activators or other acidic developers may also be present in certain embodiments. In certain embodiments, however, an activator of formula II (or the other acids listed as activators herein) is at least 50% (by weight), usually at least 90%, and most often 100% of the activators and other developers present in the heat-sensitive color-forming layer.

In a preferred embodiment the activator is a compound of formula II, more preferably a compound where $R^3$ is methylene, and most preferably the compound 3-(4-hydroxyphenyl)propionic acid. The activator is preferably used with the unsubstituted dibenzyl phosphate modifier; the combination of 3-(4-hydroxyphenyl)propionic acid and unsubstituted dibenzyl phosphate being particularly preferred.

The leuco dye is an electron-donating dye precursor. Upon achieving reactive contact with the activator, the leuco dye undergoes a structural change resulting in color formation. The leuco dye is usually substantially colorless before the reactive contact with the combination of activator and/or modifier, though it is possible for the leuco dye to be initially colored and to form a different color upon reactive contact with the activator and/or modifier e.g., color formation in this case is a striking shift or change in color. The preferred "substantially colorless" leuco dye means that the dye is colorless or is lightly or faintly colored, prior to activation.

Leuco dyes are well known color-forming compounds in the art and include chromogenic compounds such as the phthalide, leucoauramine and fluoran compounds. Examples of suitable leuco dyes include Crystal Violet Lactone (3,3-bis(4-dimethylaminophenyl)-6-dimethylaminophthalide, (U.S. Pat. No. RE 23,024); phenyl-, indolyl, pyrrolyl, and carbazolyl-substituted phthalides (for example, in U.S. Pat. Nos. 3,491,111; 3,491,112; 3,491,116; 3,509,174); nitro-, amino-, amido-, sulfonamido-, aminobenzylidene-, halo-, anilino-substituted fluorans (for example, the U.S. Pat. Nos. 3,624,107; 3,627,787; 3,641,011; 3,642,828; 3,681,390); spirodipyrans (U.S. Pat. No. 3,971,808); and pyridine and pyrazine compounds (for example, in U.S. Pat. Nos. 3,775,424 and 3,853,869). Other specifically eligible chromogenic compounds, not limiting the invention in any way, are: 3-diethylamino-6-methyl-7-anilino-flouran (U.S. Pat. No. 4,510,513); 3-dibutylamino-6-methyl-7-anilino-fluoran; 3-dibutylamino-7-(2-chloroanilino) fluoran; 3-(N-ethyl-N-tetrahydrofurfurylamino)-6-methyl-7-3,5'6-tris(dimethylamino)spiro[9H-fluorene-9,1'(3'H)-isobenzofuran]-3'-one; 7-(1-ethyl-2-methylindole-3-yl)-7-(4-diethylamino-2-ethoxyphenyl)-5,7-dihydrofuro[3,4-b]pyridin-5-one (U.S. Pat. No. 4,246,318); 3-diethylamino-7-(2-chloroanilino)fluoran (U.S. Pat. No. 3,920,510); 3-(N-methylcyclohexylamino)-6-methyl-7-anilinofluoran (U.S. Pat. No. 3,959,571); 7-(1-octyl-2-methylindole-3-yl)-7-(4-diethylamino-2-ethoxyphenyl)-5,7-dihydrofuro[3,4-b]pyridin-5-one; 3-diethylamino-7,8-benzofluoran; 3,3-bis(1-ethyl-2-methylindole-3-yl)phthalide; 3-diethylamino-7-anilinofluoran; 3-diethylamino-7-benzylaminofluoran; and 3'-phenyl-7-dibenzylamino-2,2'-spirodi-[2H-1-benzopyran]. The leuco dye present in the heat-sensitive color-forming layer of the present invention can be a single species or a mixture of two or more species.

The heat-sensitive color-forming layer contains the leuco dye, activator, phosphate modifier, and optionally a sensitizer or other adjuvant, dispersed in a binder. The binder, as is well known in the art, serves as an adherent of the layer (e.g., layer-forming material) and facilitates the positioning and coating of the color-forming components. The binder generally facilitates adhesion of the coated layers to the substrate and/or among any sublayers. The binder can also provide protection of the recording material against handling forces. The binder is usually a polymeric material, including water-soluble and water-insoluble polymers as well as mixtures thereof. Examples of water-soluble polymers include polyvinyl alcohol, hydroxy ethylcellulose, methylcellulose, methyl-hydroxypropylcellulose, starch, modified starches, gelatin and the like. Examples of water-insoluble polymers include polyacrylates, styrene-butadiene-rubber latexes, polyvinylacetates, polystyrene, and the like. More than one binder can be present. Typically polyvinyl alcohol is used as the binder, optionally with the addition of a water-insoluble binder such as styrene-butadiene. The amount of the binder is easily determined by a worker skilled in the art and generally is sufficient, given the composition, to afford protection against brushing and handling forces but less than an amount that will interfere with achieving reactive contact between color-forming reactive materials.

Beyond being dispersed in a binder, the leuco dye, activator, and phosphate modifier are in a substantially contiguous relationship. The term "substantially "contiguous" is understood to mean that these color-forming components are positioned in sufficient proximity such that upon melting, softening or subliming one or more of the components, a reactive color forming contact between the components is achieved. As is readily apparent to the person of ordinary skill in this art, these reactive components can be in the same coated layer or layers, or isolated or positioned in separate layers. In other words, one component (e.g., the leuco dye) can be positioned in a first sub-layer and another component (e.g., the activator and/or phosphate modifier) positioned in a subsequent sub-layer or sub-layers coated thereon to form the color-forming layer. All such arrangements that offer reactive color formation upon melting, softening or subliming one of the color-forming components are understood herein as being substantially contiguous. For clarity, the phrase "dispersed in a binder" is met even if the leuco dye, activator, and phosphate modifier are dispersed in different binders or in separate sub-layers. Typically the heat-sensitive color-forming layer is a single coated layer having the leuco dye, acidic developer, and sensitizer substantially homogeneously distributed throughout the coated layer material deposited on the substrate.

The amounts and ratios of the color-forming components are not particularly limited and are commonly determined by workers skilled in the art. In general the weight ratio of activator to leuco dye is usually maintained within the range from about 0.5:1 to about 10:1, often 1:1 to 5:1. The weight ratio of phosphate modifier to leuco dye is also typically within the range of 0.5: to 10:1, often 1:1 to 5:1. The total amount of the activator and phosphate modifier components is typically within the range of 15 to 65% the total weight (dry) of the heat-sensitive color-forming layer. The ratio of activator to phosphate modifier is usually within the range of 1:10 to 10:1. The leuco dye is typically used at from 5 to 30% by weight (dry) based on total solids of the coating.

The heat-sensitive color-forming layer can contain additional additives as is well known in the art. Examples of such additives include pigments, waxes, lubricants, wetting agents, defoamers, and anti-oxidants. Pigments include clay, talc, silicon dioxide, aluminum hydroxide, calcined kaolin clay and calcium carbonate, and urea-formaldehyde resin pigments. Waxes include natural waxes, Carnauba wax, and synthetic waxes. Lubricants include zinc stearate.

The heat-sensitive color-forming layer is carried on a substrate. The substrate is any material that can carry or support the heat-sensitive coating-layer; i.e., any material onto which the color-forming layer can be coated or applied. The kind or type of substrate material is not critical. Generally the substrate is in sheet form. For purposes of this invention, sheets can be referred to as support members and are understood to also mean webs, ribbons, tapes, belts, films, cards and the like. Sheets denote articles having two large surface dimensions and a comparative small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. The usual and preferred substrate is the typically employed neutral sized base paper.

The heat-sensitive color-forming layer is usually coextensive with the substrate, but such is not required. In some embodiments the heat-sensitive color-forming layer occupies only a portion of the substrate; the remaining portions may be blank, have printed information, different layers/materials, etc. Also, when the color-forming layer is not coextensive, the substrate may carry two or more heat-sensitive color-forming layers in different locations on the substrate and such different color-forming layers may be the same or different in terms of composition.

The thermal recording material can contain additional layers. Layer(s) can be provided between the substrate and the heat-sensitive color-forming layer for a variety of purposes including ease of coating, improved resolution, and/or reducing heat transfer to the substrate. A top coat and/or back coat can also be provided; i.e., over the heat-sensitive color-forming layer and/or on the opposite or back side of the substrate. Such layers generally provide protection and/or handling advantages. In one embodiment, the thermal recording material of the present invention is top coated with a polymeric coating such as polyvinyl alcohol or any of the other polymers mentioned above as suitable binders.

The thermal recording material of the present invention can be made by methods known in the art. The phosphate modifiers of formula I and the activators of formula II are commercially available compounds and/or can be readily made or obtained by persons skilled in the art. The leuco dye(s), binder(s), and substrate are generally commercially available. The thermal recording material is typically made by coating a dispersion or suspension of the heat-sensitive color-forming layer materials onto the substrate. For convenience the dispersion or suspension is water-based and the leuco dye, activator, and phosphate modifier are dispersed therein. These solid color-forming materials are usually milled to a size of 10 microns or less, often 3 microns or less.

In one process, a dispersion of a particular system component can be prepared by milling the component (i.e., leuco dye) in an aqueous solution of the binder (or a latex of the binder if the binder is water-insoluble) until a particle size of less than 10 microns is achieved. The milling can be accomplished in an attritor or other suitable milling device. Once a dispersion of each of the leuco dye, activator, and phosphate modifier is formed, these three dispersions are mixed in the desired ratios. Other materials such as fillers, sensitizers, antioxidants, lubricants, waxes, etc., can be added if desired. The resulting dispersion can be applied to a substrate using any suitable coating technique, e.g., with a wire wound rod, and then dried to form the heat-sensitive color-forming layer. Typically the heat-sensitive color-forming layer has a coating weight wet of about 3 to about 9 grams per square meter (gsm) and preferably about 5 to about 6 gsm. The practical amount of color-forming materials is controlled by economic considerations, functional parameters and desired handling characteristics of the coated sheets. Further post-layer forming steps can be performed such as additional coatings and, in the case of a sheet substrate, the material may be calendered to improve smoothness.

EXAMPLES

A 20 wt % dispersion of 3-(4-hydroxyphenyl)propionic acid (HyPPA) in water is milled overnight using a ceramic ball mill. The typical ceramic jar capacity is 1.0 L (size 00) and the media used is zirconia of ⅜" radius end cylinder size from U.S. Stoneware. This results in a uniform dispersion of the HyPPA with a reduced particle size suitable for thermal imaging applications (<10 μm).

Formulations for coating, in 4 gram batches, are prepared by mixing all components in a small SpeedMixer threaded cap vessel. The formulations are then mixed using a Flacktek Speedmixer (Model DAC 400) at 2000 rpm for 2 mins. After mixing, formulations are coated in triplicate onto Appleton paper using a #10 Meier type wire-wound coating rod (approximately 25 μm wet film thickness). The films are then allowed to air dry and followed with a second coating of a protective thermal imaging overcoat (if required). Once dry, the coated paper is then processed through a thermal imaging printer (Atlantek Model 300). The resulting imaged bars were then analyzed for color density using a Gretag Macbeth Model D19C handheld densitometer. An example coating formulation is shown below:

| Ingredient | Mass |
|---|---|
| Albacar/Calgon Slurry (clay) | 0.720 |
| Dibenzyl Phosphate | 0.840 |
| 3-(4-Hydroxyphenyl)propionic acid | 1.050 |
| APS Wax Grind (wax) | 0.311 |
| Selvol 125 PVA (polyvinyl alcohol) | 0.057 |
| Hidorin H-256 (lubricant) | 0.057 |
| ODB2 3 butylamino-6-methyl 7-aniline-fluoran | 0.336 |
| Process Water | 0.000 |
| Sub-total | 3.986 |
| Adjustment Water | 0.014 |
| Total (g) | 4.000 |

Five coating formulations, based on the above example formulation were made using differing amounts of dibenzyl phosphate ("DBP") and 3-(4-hydroxyphenyl) propionic acid ("HyPPA"), but keeping the total amount of phosphate modifier and activator constant. These formulations were coated and tested with nine different imaging intensities. The formulations and the results are reflected in Table 1.

TABLE 1

| Composition (Wt %) | Control (C) Background Density (Db) | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|---|
| 5% DBP 40% HyPPA | 0.04 | 0.11 | 0.4 | 0.76 | 0.98 | 1.05 | 1.04 | 1.17 | 1.15 | 1.16 |
| 10% DBP 35% HyPPA | 0.03 | 0.11 | 0.32 | 0.74 | 0.92 | 1.01 | 1.03 | 1.06 | 1.05 | 1.07 |
| 20% DBP 25% HyPPA | 0.06 | 0.22 | 0.49 | 0.95 | 1.25 | 1.25 | 1.22 | 1.27 | 1.21 | 1.32 |
| 25% DBP 20% HyPPA | 0.07 | 0.15 | 0.41 | 0.83 | 1.01 | 1.04 | 1.02 | 1.01 | 1.02 | 1.05 |
| 40% DBP 5% HyPPA | 0 | 0.01 | 0.05 | 0.16 | 0.37 | 0.43 | 0.47 | 0.5 | 0.5 | 0.51 |

Over the nine different exposure levels, the various mixtures of activator and phosphate modifier can provide an image. Even when as little as 5% HyPPA (activator) is used, the sample can provide color formation in the higher exposure range.

Each of the patents and patent applications mentioned above are incorporated herein by reference The invention having been thus described, it will be obvious to the worker skilled in the art that the same may be varied in many ways without departing from the spirit of the invention and all such modifications are included within the scope of the present invention as set forth in the following claims.

We claim:

1. A thermal recording material, which comprises a substrate having provided thereon a heat-sensitive color-forming layer; said color-forming layer comprising a binder having dispersed therein, and in a substantially contiguous relationship, a leuco dye, an activator, and a phosphate modifier; wherein said phosphate modifier is selected from one or more compounds of Formula I:

Formula I

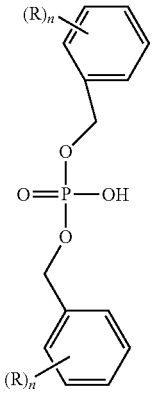

wherein each R is independently selected from an alkyl group or an alkoxy group; and n is an integer from 0 to 3.

2. The thermal recording material according to claim 1, wherein R is selected from a C1-C6 alkyl group or a C1-C6 alkoxy group.

3. The thermal recording material according to claim 1, wherein n is 0.

4. The thermal recording material according to claim 1, wherein said activator is selected from the group consisting of benzoic acid, 3,4-dihydroxyphenyl acetic acid, citric acid, salicylic acid, ascorbic acid, and tryptophan.

5. The thermal recording material according to claim 1, wherein said activator is one or more compounds of formula II:

Formula II

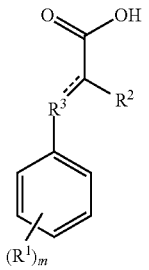

wherein $R^1$ is hydroxyl or an alkoxy group; $R^2$ is hydrogen, hydroxyl, or amino; $R^3$ is a C1 to C4 hydrocarbon linking group; and m is an integer of 1 to 3.

6. The thermal recording material according to claim 5, wherein $R^3$ is methylene.

7. The thermal recording material according to claim 1, wherein $R^1$ is hydroxyl and m is 1.

8. The thermal recording material according to claim 7, wherein said activator is 3-(4-hydroxyphenyl)propionic acid.

9. The thermal recording material according to claim 8, wherein said phosphate modifier is a compound of formula I wherein n is 0.

10. The thermal recording material according to claim 1, wherein the weight ratio of said activator to said leuco dye is within the range of about 0.5:1 to 10:1.

11. The thermal recording material according to claim 1, wherein the weight ratio of said phosphate modifier to said leuco dye is within the range of about 0.5:1 to 10:1.

12. The thermal recording material according to claim 1, wherein said heat-sensitive color-forming layer is a single coated layer.

13. The thermal recording material according to claim 1, wherein said heat-sensitive color-forming layer is comprised of two sub-layers; a first sub-layer containing said leuco dye and a second sub-layer containing said activator and said phosphate modifier.

14. The thermal recording material according to claim 1, wherein said leuco dye is substantially colorless prior to reacting with said activator.

15. The thermal recording material according to claim 1, wherein said leuco dye is an electron-donating dye precursor selected from the group consisting of phthalides, leucoauramines, fluorans, spirodipyrans, pyridines, and pyrazines.

16. The thermal recording material according to claim 1, wherein said leuco dye is selected from the group consisting of (3,3-bis(4-dimethylaminophenyl)-6-dimethylaminophthalide; 3-diethylamino-6-methyl-7-anilino-flouran; 3-dibutylamino-6-methyl-7-anilino-fluoran; 3-dibutylamino-7-(2-chloroanilino) fluoran; 3-(N-ethyl-N-tetrahydrofurfurylamino)-6-methyl-7-3,5'6-tris (dimethylamino)spiro[9H-fluorene-9,1'(3'H)-isobenzofuran]-3'-one; 7-(1-ethyl-2-methylindole-3-yl)-7-(4-diethylamino-2-ethoxyphenyl)-5,7-dihydrofuro[3,4-b] pyridin-5-one; 3-diethylamino-7-(2-chloroanilino)fluoran; 3-(N-methylcyclohexylamino)-6-methyl-7-anilinofluoran; 7-(1-octyl-2-methylindole-3-yl)-7-(4-diethylamino-2-ethoxyphenyl)-5,7-dihydrofuro[3,4-b]pyridin-5-one; 3-diethylamino-7,8-benzofluoran; 3,3-bis(1-ethyl-2-methylindole-3-yl)phthalide; 3-diethylamino-7-anilinofluoran; 3-diethylamino-7-benzylaminofluoran; 3'-phenyl-7-dibenzylamino-2,2'-spirodi-[2H-1-benzopyran]; and mixtures of two or more thereof.

17. The thermal recording material according to claim 1, wherein said binder comprises polyvinyl alcohol.

18. The thermal recording material according to claim 17, wherein said binder further comprises styrene-butadiene.

19. The thermal recording material according to claim 1, which further comprises at least one additive selected from the group consisting of pigments, waxes, lubricants, wetting agents, defoamers, and anti-oxidants.

20. A thermal recording material, which comprises a substrate having provided thereon a heat-sensitive color-forming layer that comprises a leuco dye, 3-(4-hydroxyphenyl)propionic acid and dibenzyl phosphate dispersed in a binder and in substantially contiguous relationship.

* * * * *